United States Patent [19]

Johnson

[11] Patent Number: 4,993,079

[45] Date of Patent: Feb. 19, 1991

[54] DEVICE FOR SECURING HAT

[76] Inventor: Charlotte W. Johnson, 1075 Duna Dr., Laramie, Wyo. 82070

[21] Appl. No.: 345,963

[22] Filed: May 1, 1989

[51] Int. Cl.[5] ..... A42B 1/00

[52] U.S. Cl. ..... 2/181; 2/183; 2/418; 2/DIG. 11

[58] Field of Search ..... 2/171, 171.1, 175, 179, 2/181, 181.2, 181.4, 181.6, 181.8, 182.5, 182.6, 182.7, 182.8, 183, 185 R, 185 C, 195, 196, 197, 209.1, 417, 418, 420, 421, DIG. 11

[56] References Cited

U.S. PATENT DOCUMENTS

| | | | |
|---|---|---|---|
| 2,783,474 | 3/1957 | Campagna | 2/181 |
| 3,787,894 | 1/1974 | Goodman | 2/418 |
| 4,011,600 | 3/1977 | Malk | 2/183 |
| 4,023,212 | 5/1977 | Huffman | 2/171.1 |
| 4,131,953 | 1/1979 | Kimotsuki | 2/182.6 |
| 4,393,519 | 7/1983 | Nicastro | 2/DIG. 11 |
| 4,439,871 | 4/1984 | Plastino | 2/418 |
| 4,630,317 | 12/1986 | Brown | 2/171 |

FOREIGN PATENT DOCUMENTS

| | | | |
|---|---|---|---|
| 569860 | 2/1959 | Canada | 2/181 |

*Primary Examiner*—Werner H. Schroeder
*Assistant Examiner*—Diana L. Biefeld

[57] ABSTRACT

Device for securing a hat in adverse wind conditions is disclosed: the non-permanent attachment to hat (22) can be either inconspicuous or decorative depending on preference of wearer. The device is a headband (10) with woven loop fiber pieces (14*a*), (14*b*), (14*c*), that attach to matching cut loop pieces (16*a*), (16*b*), (16*c*), in the inner band (24) of hat (22). The placement of these pieces compensates for aerodynamic affects and holds hat (10) secure. The design of the device allows the wearer to concentrate on performance and task orientation without worry about the hat blowing off.

3 Claims, 2 Drawing Sheets

DEVICE FOR SECURING HAT

BACKGROUND—FIELD OF INVENTION

Figure 1:
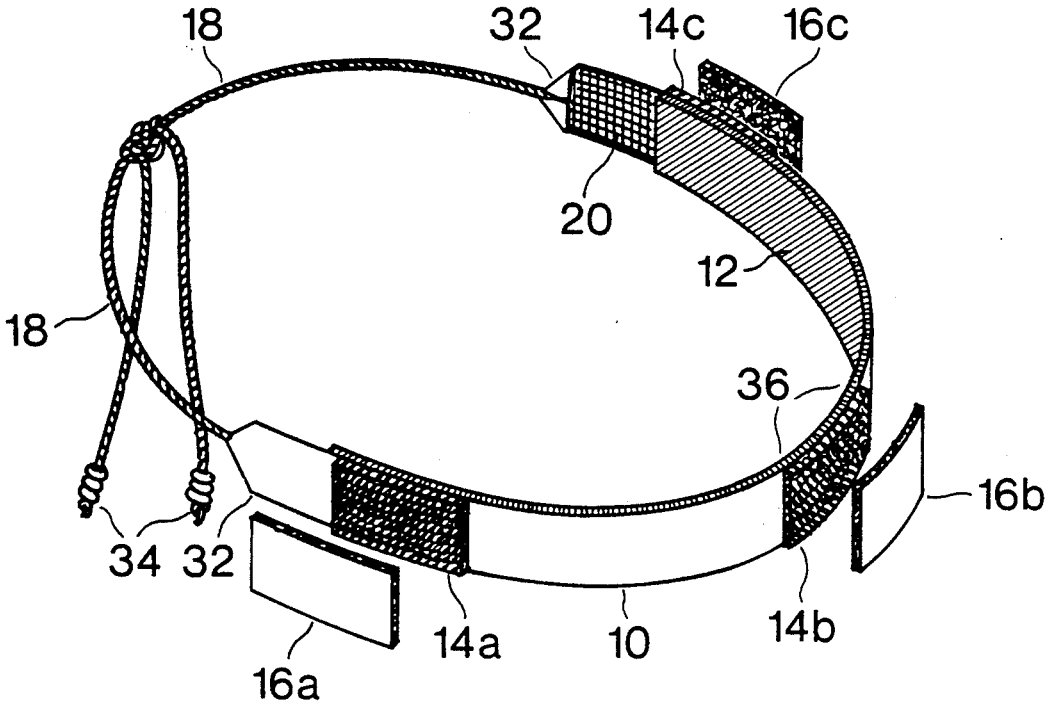

This invention relates to wearing apparel, specifically to use of a headband designed and constructed for securing a heat on the wearer's head under adverse wind conditions.

BACKGROUND—DESCRIPTION OF PRIOR ART

Headbands have been used as decorative apparel, and for holding the hair away from the forehead and eyes. As typified in U.S. Pat. No. 556,672 (1983) Wishman's headband has utility in sports activities for perspiration retention and cooling. The purpose for these headbands is different in function and construction than any relating to the present invention.

Headbands have been used for costuming, identification, advertising promotions and for the functional use as protective receptacle for eye glasses disclosed in U.S. Pat. No. 2,557,552 (1848) to Martin. These headbands have limited use and function evidenced by the purpose for which the design was intended, requiring that the headbands be conspicuously worn.

A hat adjusting device having an adjustable sweatband for controlling the tightness of the fit of the hat, U.S. Pat. No. 4,011,600 issued to Malk (1977) is used inside the band of the hat and can be adjusted by a draw loop. A strip of padding used for moisture absorption extends between the strap and sweatband to provide a cushion between the fastening device and head of the wearer. The disadvantage to this design relative to the present invention is that the hat must have an inside extendable band in order to insert the sweatband. The band adjusts only the tightness of the hat and does not address whether or not the hat will stay on. There is no method provided for actual attachment of the band to the hat. The size of the band must meet the hat size in order to be effectively adjustable. The purpose of the adjusting device is for padding and for filling space to help size the hat rather than provide a solution to the hat blowing off in the wind.

Hat and sweatband insert as typified in U.S. Pat. No. 3,578,736 issued to Dootson (1971) addresses the function of a discardable sweatband to be used inside a hat strictly for perspiration absorption which allows evaporation of the moisture, giving a cooling effect. This device meets the function for which it was intended, but has no adjustable method for sizing and does not intend to keep the hat secured to the head in adverse wind conditions.

Sports cap sweatband as discussed in U.S. Pat. No. 3,409,910 issued to Massa (1968) is secured inside the hat crown by plates and slot tabs allowing the sweatband to be removable from the hat. The sport cap sweat band has no adjustment potential, is not intended for size variations or to secure hats in general. The cap must be of such fabric and design that the tabs can be inserted into the crown, otherwise it would damage the hat. It appears that hats of general use and style could not benefit from the device.

Hat attachments are classified as those permanently attached bands inside the hard hat or helmet style hat to be adjusted from side top to nape of neck. These bands or attachments are made of leather, plastic or hard rubber and may or may not be adjusted for size by a clip or bolo style clamp as typified by U.S. Pat. No. 2,550,575 (1945). This attachment is limited to the use of hats that have a helmet style design, giving a specific purpose for its function. The band is permanently inserted into the hat, adjusted for tightness on the head without concern for whether the hat is secure. The band is not pliable, but of a rigid substance which has no regard for comfort or style.

Heretofore the Stampede string or Tom Mix Loop, which attaches to the brim of the hat and fastens under the chin by tying the string or adjusting it with a slide or bolo, is the closest item to the present invention which addresses the functional purpose of securing a hat onto the wearer's head in adverse wind conditions.

The Stampede string was designed to hold a hat on the head. It is not secured to the head but attaches to the hat and requires that the wearer pull it tightly under the chin and secure it. Several disadvantages of this device are:

1. It is difficult to have the string tight enough to be effective without pushing the hat down onto the head so far that it could obstruct the vision of the wearer.
2. The hat is susceptible to wind draft and lift in motion and the Stampede string does not compensate for aerodynamic lift.
3. When air current rides under the hat brim, the hat lifts and falls backward because there is no attachment for the hat to grip to stabilize it.
4. The Stampede string is an obvious, visible device and cannot be inconspicuously worn to meet even the lowest percentage of effective function.
5. The wearer is concerned about the hat blowing off the head which interferes with the concentration and performance.

No prior art has been discovered that has the distinctive utility of a headband or hatband with combination of new materials specifically designed for holding the hat securely on the head of the wearer in adverse conditions of wind or at high speed.

The present invention was specifically designed to meet the needs of the rodeo barrel racers, but surprisingly is becoming a device of variable uses. Anyone who wears a hat can benefit from using the present invention for securing the hat.

Ranchers, farmers, baseball players, marching band, drill team, drum and bugle corp participants, as well as gardeners, hikers, skiers, exhibition riders and people who need hat protection from the sun can feel confident that their hats will stay on. The present invention allows the wearer to concentrate on the task at hand without worrying about the hat blowing off.

OBJECTIVES AND ADVANTAGES

Accordingly several objects and advantages of the present invention are:

(a) to provide a device for easily, readily and inconspicuously affixing the hat onto the wearer's head;

(b) to provide a device that will eliminate the adverse affects of wind on the hat because of a design that compensates for aerodynamic effects;

(c) to provide a device that will allow hat wearers to feel confident and task-oriented because the hat will stay on when the present invention is used;

(d) to provide a device that will encourage and promote the trend of hat wearing while eliminating the concerns about loss, damage, size adjustment and adverse conditions that now concern hat wearers;

(e) to provide a device that will meet the function of utility in a novel, unobvious manner without concern for ease of use, size, appearance and convenience for all ages;

(f) to provide a device that can be used by all hat wearers, for the purpose of securing a hat on the head under adverse wind conditions;

(g) to provide a device that can be adjusted for size to accommodate all sizes and styles of hats;

(h) to provide a device that is detachable and easily replaceable which permits the wearer to use it at will;

(i) to provide a device that will secure the hat without puncturing the hat fabric or defacing the exterior;

(j) to provide a device that will meet the needs of people who are required to wear a hat and then are penalized for having it come off.

Further objects and advantages for the present invention over any and all other prior art forms are many and varied. Never before has any method of securing a hat addressed the problem of securing the hat in adverse wind conditions, with these advantages. The present invention allows the wearer to keep the hat on without worry about loss and damage during outdoor activities that would normally present a concern. The present invention is lightweight, inconspicuous, adjustable, durable, comfortable, stylish and economically affordable. Still further objects and advantages will become apparent from a consideration of the ensuing description and drawings.

DRAWING FIGURES

FIG. 1. Shows the invention comprising the headband and all the components.

Figure 2:
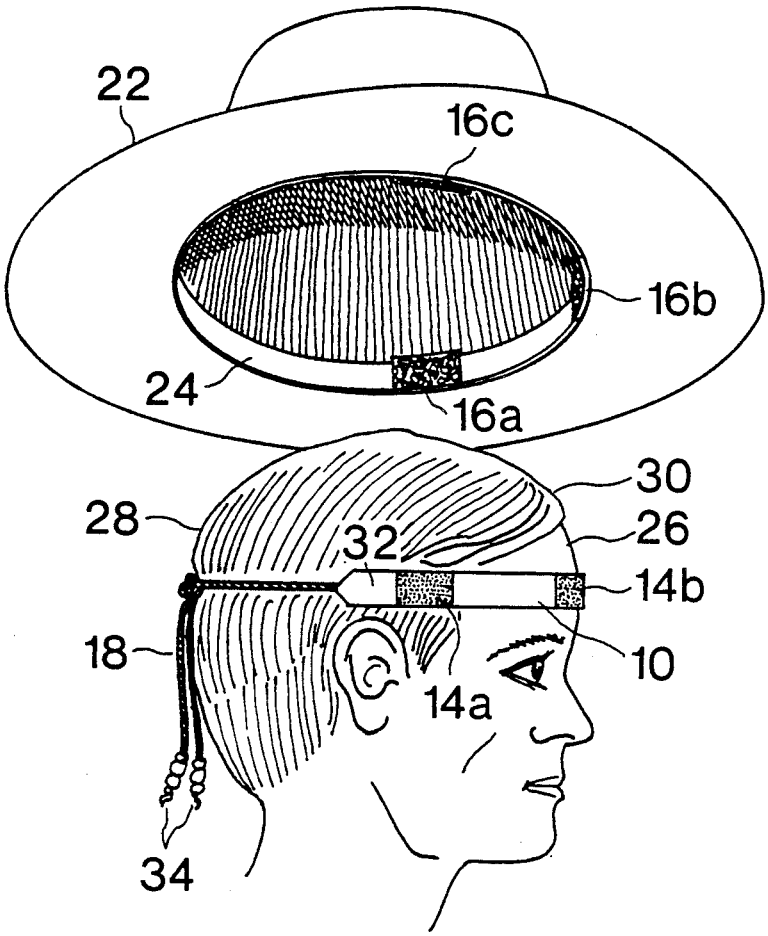

FIG. 2. Shows positioning of headband on head of wearer and placement of adhesive strips on inner band of the hat.

DRAWING REFERENCE NUMERALS

10: headband
12: porous thin material
14*a*, 14*b*, 14*c*: looped fiber strip
16*a*, 16*b*, 16*c*: cut loop fiber strip partners of 14*a*, 14*b*, 14*c*
18: decorative string or cord
20: backside of 10
22: hat
24: inner band of 22
26: forehead of 30
28: backside of 30
30: head
32: miter corner finished ends of 10
34: beads on 18
36: center front of 10

DESCRIPTION

A preferred embodiment of the headband design and components of the present invention is illustrated in FIG. 1. The headband 10 comprises a length of stretch fabric which has the properties of flexibility and resilience and measures approximately fourteen to sixteen inches in length by about one inch with a thickness of one-eighth to one-fourth inch. The bank 10 has a woven finished surface on the front side of 10 and a loosely woven back side 20 made of cotton and rubber or cotton and polyester blend. However, headband 10 can consist of any fabric that has finished edges, allows for stretch and is flexible with a thickness less than one-half inch.

To back side 20 of headband 10 is affixed a length of porous thin material 12 such as craft foam ART FOAM, FIBRE-CRAFT MATERIALS CORP. or sponge measuring approximately twelve inches long by one inch wide with a thickness of one-sixteenth to one-eighth of an inch. The craft foam is positioned to be equal distance longitudinally from each end of the headband 10 being permanently affixed so as not to be visible on the front side of headband 10.

A length of decorative string 18 measuring approximately ten inches by one-fourth in diameter is sewn to each end of stretch fabric by process of miter corners 32 to encase the string 18 and raw edges of headband 10. Miter corner 32 is secured to reinforce decorative string 18 to headband 10.

The addition of glass, plastic or wooden beads 34, strung onto the loose ends of decorative string 18 and secured with a knot is shown in the preferred embodiment. However, other items of decoration, fad or trend such as buttons, silver concho, or knotting designs can be substituted.

Looped fiber strips 14*a*, 14*b*, 14*c*, VELCRO, VELCRO USA INC. in the preferred embodiment, each measuring approximately one inch wide and one and one-half inches in length are affixed to headband 10. Looped fiber strip 14*b* is permanently fixed to center front 36 of the front side of headband 10. Looped fiber strips 14*a*, 14*c* are placed equal distance to the left of 14*b* thereby affixing them permanently onto the front side of headband 10.

Cut loop fiber strips 16*a*, 16*b*, 16*c*, matched partners to looped fiber strips 14*a*, 14*b*, 14*c*, are positioned equal distances apart with 16*b* as the center front match to 14*b*. strips 16*a*, 16*b*, 16*c* are bonded with adhesive onto the inner band 24 of hat 22 as illustrated in FIG. 2.

The designated product VELCRO, VELCRO USA INC. is necessary to the function, utility and design of the present invention. The property of VELCRO, VELCRO USA INC. has the ability to be affixed by adhesive bonding to a surface. Additionally, VELCRO, VELCRO USA INC. has the ability to attach one surface to a matched partner for holding objects together for a semipermanent attachment.

Heretofore an embodied product providing the unique results of the VELCRO, VELCRO USA INC. as used in the description and design of the present invention has not been found suitable. Options for future embodiment, should such a substance become available are implied.

From the description above, a number of advantages of the present invention become evident:

(a) materials used in the design could be altered for additional embodiments that would result in custom designing or improved performance without affecting the novel, unobvious use and function of the present invention;

(b) the purpose for which the materials have been uniquely combined is determined by a need that can be met when components as described are used.

OPERATION

Referring to FIGS. 1 and 2 the device for securing a hat has the utility of a headband specifically designed to combat aerodynamic lift for holding the hat securely on the head of the wearer in adverse conditions.

A stretch fabric which comprises headband 10 gives elongated stretch and resilience to the present invention which holds taut when placed around forehead 26 and tied securely with decorative string 18 at backside of head 28.

Properties of the headband fabric must allow the fabric to bend and stretch easily so headband 10 will readily conform to the shape of head 30 and can be pulled taut to secure it.

A textured woven fabric with finished edges comprising of cotton or polyester and rubber blend provides the base for headband 10 giving a surface less than smooth on the front side.

The width and length of headband 10 have been determined for the design and operation of the present invention. The headband 10 does not need to be continuous around head 20. It is possible to get a tighter fit and more superior results if headband 10 is one-half to three-fourths encompassing and tied with string 18 attachments.

As embodiment of the present invention would allow a continual headband 10 encompassing the circumference of head 20 and attaching with an overlap device or a tab closure on back side 28 of head 20.

The design and operation of the present invention allows for one size to fit all and does not necessarily require a change in hat size to accommodate the device.

A porous thin material 12 designated as craft foam, ART FORM, FIBRE CRAFT MATERIALS CORP. affixed to the backside 20 of headband 10 provides a non-slip surface which grips onto forehead 26 preventing headband 10 from slipping upward when wind current catches under the brim of hat 22 creating aerodynamic lift. Thin material is important to keep headband 10 lightweight and thin in size.

Decorative strings 18 attached to ends of stretch fabric headband 10 provide a method for securing headband 10 and decorated with beads 34 or other embodiments such as concho slide, feathers or knotted designs, buttons or bolo.

The decorative strings 18 are sewn by method of miter corners 32 to secure string 18 to ends of stretch fabric and to complete the edges of headband 10. Tied decorative string 18 fasteners are adjusted for size, determined by how tight the wearer desires headband 10 to fit. This adjustment method allows one size to fit all.

Placement of the looped fiber strips **14*a*, 14*b*, 14 *c* on headband 10 requires strip 14*b* to be centered evenly over center front section 36 of headband 10. Strip 14*a* and 14c must be spaced equal distance apart to right and left of strip 14*b*. It is necessary to stabilize the hat from center front to forehead 26** area and directly near the ear to counter balance the effect of wind draft and lift while in motion.

The cut looped fiber strips **16*a*, 16*b*, 16 *c* which are matched partners for looped fiber strips 14*a*, 14*b*, 14*c* must be placed on inner band 24 of hat 22 in corresponding position to meet with partner on headband 10 when hat 22 is placed on head 30**.

The connecting property of the VELCRO, VELCRO USA INC. partners on headband 10 and inner band 24 of hat 22 with the grip function of the craft foam 12 ART FOAM, FIBRE CRAFT MATERIALS CORP. on back side 20 of headband 10 being held taut to head 30 with decorative string 18 provides the novel design and functional use of the present invention.

In operation user first determines center front 36 section of headband 10 placing foam fabric surface on backside 12 of headband 10 against forehead 26. Stretching band 10 slightly will hold it taut on head 30 when tied securely with decorative string 18 at backside 28 of head 30.

Lastly with headband 10 on head 30 and strips **16*a*, 16*b*, 16*c* bonded to inner band 24 of hat 22 as illustrated in FIG. 2, the user holds hat 22 in hand. The user matches center front 36 of headband 10 containing strip 14*b* with strip 16*b* on inner band 24 of hat 22 and presses hat 22 down onto head 30, using opposite hand to push headband 10 upward to meet inner band 24 of hat 22. Matched strips 14*a*, 14*b*, 14*c* will meet and connect with strips 16*a*, 16*b*, 16*c* thus holding hat 22 securely on head 30** of the wearer.

The present invention is not a permanent attachment to the hat. Each time hat 22 is worn, headband 10 must be secured onto head 30 as described above, before hat 22 is put on. However, VELCRO, VELCRO USA INC. strips **16*a*, 16*b*, 16*c* are permanently bonded to inner band 24 of hat 22 which does not affect the comfort or function of hat 22**. The user then has the option of deciding when to wear hat securing device.

The designated product VELCRO, VELCRO USA INC. is necessary to the function, utility and design of the present invention. The property of VELCRO, VELCRO USA INC. has the ability to be affixed by adhesive bonding to a surface. Additionally, VELCRO, VELCRO USA INC. has the ability to attach one surface to a matched partner for holding objects together for a semipermanent attachment.

SUMMARY, RAMIFICATIONS, AND SCOPE

Thus the reader will see that the unique construction and use of the present invention provides a highly reliable, economical, lightweight device for easily, readily and inexpensively securing the hat onto the wearer's head.

Furthermore the device to secure a hat has the additional advantages in that

- it has been tested and designed to provide satisfactory results relating to aerodynamics in adverse wind conditions allowing the wearer to be task-oriented and composed.
- it is generally in purpose and function for all hat wearers and is not limited to specialized groups but will meet the needs and demands of all ages, sizes and gender and interests.
- it has unique utility created by the new combination of known materials to develop a new use apparel with no known prior art forms designed specifically for the purpose of holding a hat secure in adverse wind conditions.

Although the description above contains many specificities, these should not be construed as limitations on the scope of the invention, but rather an exemplification of one preferred embodiment thereof. Other variations are possible. For example:

The headband could be made of a thinner material and be a continuous band, encompassing the circumference of the head, secured with an adjustable fastener or hook loop device in place of the decorative strings;

The decorative string tied to closure could be changed to slip clamp or bolo type device for securing the headband;

Additional decorative devices, such as feathers, wooden objects, glass beads, buttons, silver and gold pieces, conchos could be used in place of the beads.

At some time it may be feasible to add or delete properties that will not change the utility or purpose of the invention, but create a new interest or fashion trend to meet the demands of the unforeseen consumer.

The properties placement and combination of materials for utility is a novel feature in the construction and design of the present invention solves the problem and fulfills the need for which the device was designed. The present invention holds the hat secure, protects the hat from loss and damage, eliminates the adverse affects of wind on the hat. The present invention allows the user to concentrate on performance and task orientation without worrying about the hat blowing off.

Accordingly, the scope of the invention should be determined not by the embodiments, but by the appended claims and their legal equivalents, rather than by the examples given.

I claim:

1. A headband and hat combination for holding a hat securely on the head of a wearer in adverse wind conditions comprising:

(a) an elongated band of elastic material having a first end and a second end;

(b) said first and second ends having mitered corners;

(c) an elongated strip of thin porous semi-transparent foam material adhered to a backside of said elastic band;

(d) first and second equal lengths of decorative string secured to said mitered corners of said first and second ends by means of stitching whereby said first and second equal lengths of decorative string may be tied together so as to secure said headband around the head of a wearer;

(e) three individual elongated strips of woven looped material attached to a frontside of said elastic band, the first strip of woven looped material positioned adjacent said first end, the second strip of woven looped material positioned adjacent said second end, the third strip of woven looped material positioned halfway between said first and second strips of woven looped material;

(f) three individual elongated strips of hook material attached to a hatband of said hat and positioned in mating relationship with said three strips of woven looped material.

2. The headband of claim 1, wherein said elastic band comprises a machine woven blend of cotton and rubber.

3. The headband of claim 1, wherein said elastic band comprises a machine woven blend of polyester and rubber.

* * * * *